US006663267B2

(12) United States Patent
Newhouse et al.

(10) Patent No.: US 6,663,267 B2
(45) Date of Patent: Dec. 16, 2003

(54) LIGHTING FIXTURE FOR WORK SPACE MANAGEMENT SYSTEM

(75) Inventors: Thomas J. Newhouse, Grand Rapids, MI (US); Ayse Birsel, New York, NY (US)

(73) Assignee: Herman Miller Inc., Zeeland, MI (US)

( * ) Notice: Subject to any disclaimer, the term of this patent is extended or adjusted under 35 U.S.C. 154(b) by 0 days.

(21) Appl. No.: 10/165,337

(22) Filed: Jun. 10, 2002

(65) Prior Publication Data

US 2002/0191390 A1 Dec. 19, 2002

Related U.S. Application Data

(60) Provisional application No. 60/298,558, filed on Jun. 15, 2001.

(51) Int. Cl.[7] ..... F21S 13/10

(52) U.S. Cl. ..... 362/431; 362/33; 362/413; 362/418; 52/36.1; 52/36.2; 52/238.1; 108/50.01; 40/552; 40/564

(58) Field of Search ..... 362/147, 148, 362/151, 153, 404, 408, 413, 418, 431, 432, 33; 52/28, 36.1, 239, 238.1, 243, 36.2; 312/223; 108/50.01; 40/552, 564

(56) References Cited

U.S. PATENT DOCUMENTS

| | | | | |
|---|---|---|---|---|
| 4,849,864 | A * | 7/1989 | Forrest | 362/225 |
| 6,374,548 | B1 * | 4/2002 | Ruedinger et al. | 52/36.1 |
| 6,527,565 | B1 * | 3/2003 | Johns | 439/116 |
| 2002/0100227 | A1 * | 8/2002 | Barnhouse et al. | 52/36.1 |

FOREIGN PATENT DOCUMENTS

| | | |
|---|---|---|
| WO | WO 00/21412 | 4/2000 |

* cited by examiner

*Primary Examiner*—Sandra O'Shea
*Assistant Examiner*—John Anthony Ward

(57) ABSTRACT

A system for defining a plurality of work zones within an otherwise open area. The system includes a framework formed from a plurality of spaced apart poles extending upward from a base surface. The poles are interconnected by a plurality of crossbeams at a height substantially above a standing user. At least some of the poles are adapted to provide a raceway for the delivery of utilities. The system also includes a height-adjustable light fixture connected to the crossbeams. The light fixture extends outward from the crossbeams and is capable of projecting a light beam directly downward on the work zone of a user.

16 Claims, 5 Drawing Sheets

LIGHTING FIXTURE FOR WORK SPACE MANAGEMENT SYSTEM

RELATED APPLICATION

This application claims the benefit of the filing date pursuant to 35 U.S.C. §119(e) of Provisional Application Ser. No. 60/298,558, filed Jun. 15, 2001, the disclosure of which is hereby incorporated by reference.

FIELD OF THE INVENTION

The present invention relates generally to the field of workspace management systems for an open office. In particular, this invention relates to an adjustable overhead lighting fixture for use with a workspace management system. This invention also relates to an illuminated display element formed integrally within a workspace management system.

BACKGROUND OF THE INVENTION

Because the concept of an appropriate working environment is rapidly changing, it is necessary that any system of arranging and defining work areas be capable of many different configurations allowing rapid changeover from one arrangement to another. Although systems furniture remains a viable solution for many office environments, some business organizations have functional and esthetic requirements which cannot be practically or commercially met by such a product. In particular, the increasing use of computer equipment and work teams results in the need for an extremely flexible system. As computer technology spreads throughout the office, there is an increasing need to link a diverse range of users with electronic equipment and databases. This need is solved by a local network of communication and electrical wiring which must be easy to install, adaptive to easy change and capable of delivering cabling to individual users at a convenient location. Many current open plan systems do not meet this requirement.

A workspace management system must also include a lighting means that provides for sufficient illumination of a worker's work space without producing undue glare. In the past, light sources, such as overhead lights attached to a ceiling, were not sufficient to properly light the workspace of a user. In particular, some previous lights produce a glare that is particularly problematic when combined with the use of a computer. Additional table lights closer to the workspace can also cause problems by creating a strong intensity pool of light in the work area that could make viewing a computer difficult. In addition, in view of the number of tools a worker needs today (such as computers and telephones), the use of such additional lights can crowd an already cramped workspace.

Workspace management systems of the past have also encountered problems with way finding. More specifically, in large offices, workers are often grouped together in teams or departments having specific responsibilities. However, it is sometimes difficult for a visitor to find a particular area, team, group or individual in a large work area.

Accordingly, there is a need for a workspace management system that provides workers with effective lighting for their workspaces. Also, there is a need for a workspace management system that includes a display element that readily communicates the type of work or activity or presence of an individual in a particular work area.

SUMMARY OF THE INVENTION

The present invention is directed to an improved workspace management system with improved light and way finding capabilities.

According to a first aspect of the present invention, a system for defining a plurality of work zones within an otherwise open area is provided. The system includes a framework formed from a plurality of spaced apart poles extending upward from a base surface. The poles are interconnected by a plurality of crossbeams at a height substantially above a standing user. At least some of the poles are adapted to provide a raceway for the delivery of utilities. The system also includes a height-adjustable light fixture connected to the crossbeams. The light fixture extends outward from the crossbeams and is capable of projecting a light beam directly downward on the work zone of a user.

According to another aspect of the invention, a system for defining a plurality of work zones within an otherwise open area is provided. The system includes a framework that is formed from a plurality of spaced apart poles extending upward from a base surface. The poles are interconnected by a plurality of crossbeams. The framework is capable of being configured in groups of from one to six poles with a plurality of the groups having one or more work surfaces attached thereto in order to form a work area for a user. The system also includes an illuminated display member connected to at least one of the poles.

As used herein the term "accessories" is intended to be interpreted broadly and to include elements such as signage, garbage bins, shelves, personal storage organizers, telephone trays, personal shelves, marker boards, clocks, frames, fans and other known elements.

As used herein the term "utilities" is intended to be interpreted broadly and include elements such as power, data, HVAC and other known utility elements.

As used herein, the term "an angle of 120 degrees" or other similar language is intended to include angles substantially equal to 120 degrees, such as 115 degrees or 125 degrees.

The present invention, together with attendant objects and advantages, will be best understood with reference to the detailed description below in connection with the attached drawings.

DETAILED DESCRIPTION OF THE PREFERRED EMBODIMENTS

Figure 1:
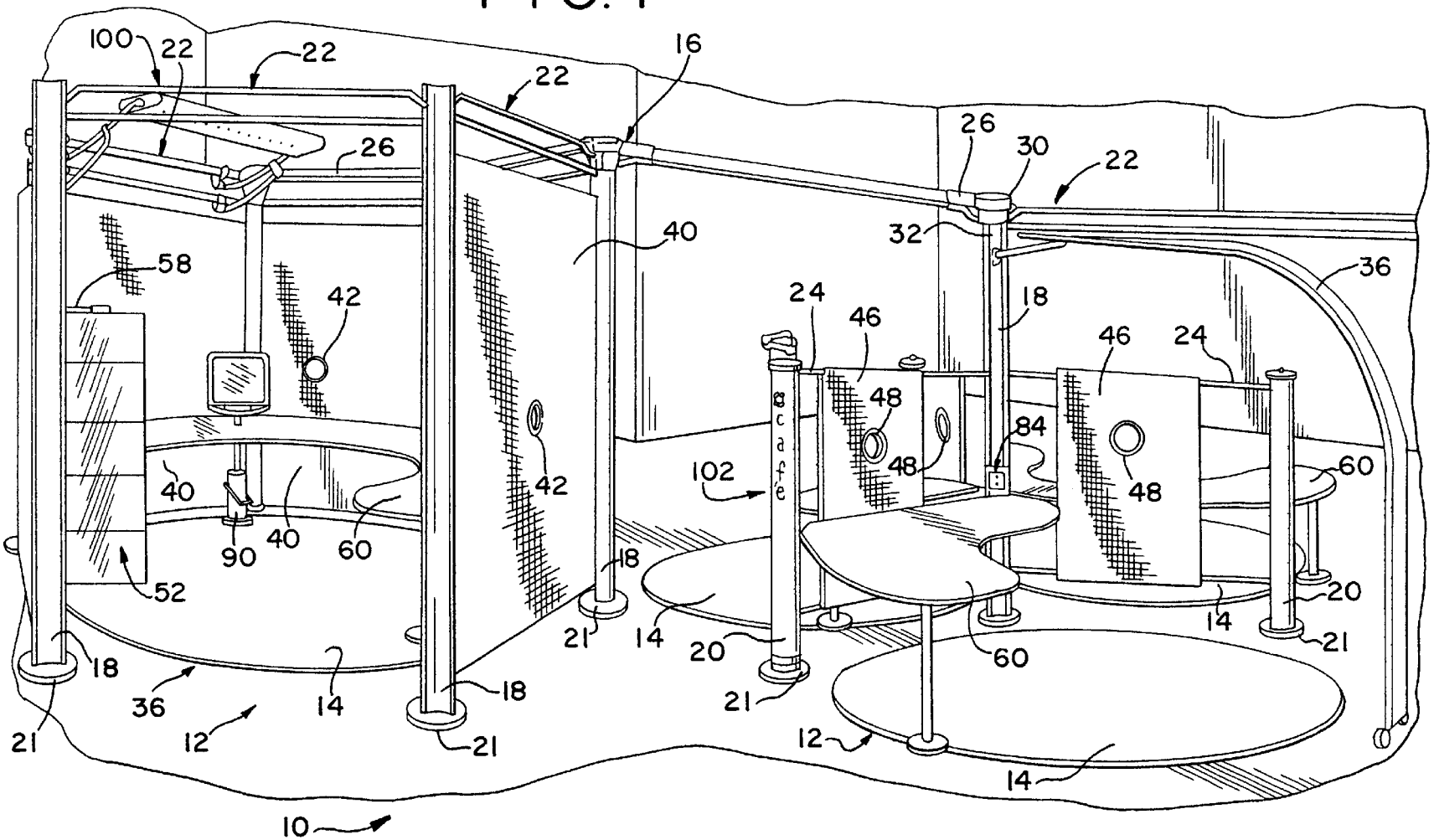
FIG. 1 illustrates an elevated side view of the system constructed in accordance with a preferred embodiment of the present invention including preferred embodiments of the height-adjustable lighting fixture and an illuminated display member.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings. It should also be understood that the drawings are not to scale and in certain instances details have been omitted which are not necessary for an understanding of the present invention, such as conventional details of fabrication and assembly.

The present invention is directed to a unique system 10 that divides up space into a plurality of work areas 12. Floor mats 14 are used to assist in the installation of the system 10 and to define personal space for each user. A three-dimensional framework 16 includes tall poles 18 and short poles 20. Upper crossbeams 22 and lower crossbeams 24 separate the space for each user. The upper crossbeams 22 can also provide for the distribution of utilities. Once assembled, the system 10 is self-supporting and does not depend on architecture or interior design elements of the space for stability. The system 10 is an open-end system adding a geometry formed primarily on the use of a 120-degree angle. The 120-degree angle provides the most economical and structurally sound geometry for the connection of poles 18, 20 and crossbeams 22, 24. The system 10 is capable of creating a plurality of workspaces of identical characteristics or unique characteristics and is also extremely effective in achieving high room densities for users.

Adjacent the floor mats 14 is the framework 16 that interconnects adjacent work areas and forms the basis for the system 10. The framework 16 includes a plurality of vertically extending poles 18, 20 extending upward from base members 21. A plurality of crossbeams such as the upper crossbeam 22 and the lower crossbeam 24 interconnect adjacent poles 18, 20. The upper crossbeam 22 includes trough 26 through which utilities pass. The connection of crossbeams 22, 24 to poles 18, 20 is at the pre-defined 120-degree angle. This self-defined, angular orientation provides for unique capabilities such as the use of space by a large number of users as well as creating a relatively easy installation process.

An aesthetic cover 30 may be attached to an upper portion 32 of the pole 18. A rotatable canopy 36 (FIG. 5) may also be attached to the upper portion 32 of the pole 18. The canopy 36 is capable of providing privacy or openness depending on its positioning. In areas having high ceiling spaces, it also helps to bring the work area 12 to a more human sized perspective. Moreover, the canopy 36 can provide an acoustical barrier for the workspace and neutralize screen glares from monitors.

With particular reference to the room 36 as illustrated in FIG. 1B, an upper crossbeam 22 may also be attached to a barrier member 40. The illustrated barrier members 40 include centrally positioned apertures 42 in the preferred embodiment. The lower crossbeams 24 as illustrated in the figures may also include barrier members 46. The barrier members 40,46 can provide various functions such as privacy, sound adsorption or storage features through the use of Velcro and connection members. Optionally, the barrier members 40,46 may be translucent, porous to air and include an aperture 48.

The lower crossbeams 24 may also be used for attachment to a storage member 52. An arm 58 is attached to the lower crossbeam 24 and extends outward therefrom. Other accessory elements may be attached to the crossbeams 22 and 24. A plurality of work surfaces 60 are shown attached to the poles 18. The poles 18, particularly the trough 26, provide for the distribution of utilities to the power receptacles 84 or data lines. The system 10 also provides for an easy access to utilities from walls, ceilings, floors or other elements. The utilities can be easily routed anywhere within the system to serve the needs of a particular user. Commercial power cabling and connectors useful with the system 10 are available from sources such Pent Inc. of Kendallville, Ind. Referring to the room 36, a monitor lift 90 is also illustrated. The monitor lift 90 is preferably attached to the pole 18. Monitor lifts can be used within the system 10 of the present invention which are not attached to a pole 18 20. For a further description of the system 10, reference is made to the U.S. patent application filed on Apr. 13, 2001 in the names of Ayse Birsel and Robert Beck et al. and entitled "Work Space Management and Furniture System" which claims priority to PCT Application No. US99/23793 filed on Oct. 13, 1999, the disclosures of which are hereby incorporated by reference.

With particular reference to the room 36, a preferred embodiment of height-adjustable lighting fixture 100 is shown attached to the overhead crossbeams 22 with the illuminated display 102 shown adjacent thereto. Turning first to the height-adjustable lighting fixture 100, it includes a number of significant advantages. For example, the cantilevered nature of the height-adjustable lighting fixture 100 allows the device to extend out from the crossbeams 22. Therefore, the height-adjustable lighting fixture 100 can be used in a low ceiling environment, e.g., beneath nine feet high. The height-adjustability feature also allows the fixture to be selectably spaced downward from a low ceiling to create a wide spread of diffused light which will bounce down softly to the work area of a user without creating glare (such as on a computer monitor). The height-adjustable lighting fixture 100 also provides a combination of direct and indirect light in order to properly illuminate a user's work area in a substantially glare-free manner.

Figure 2:
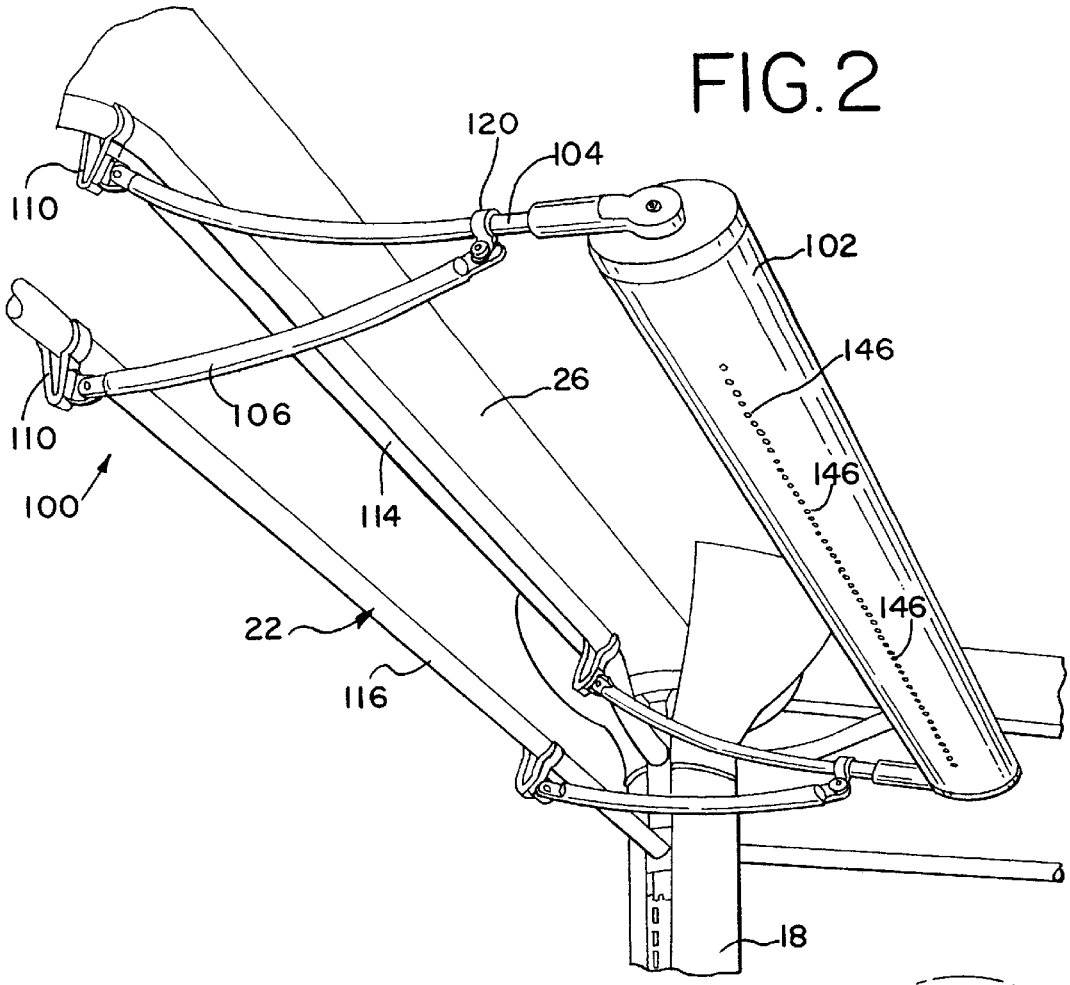
FIG. 2 is bottom perspective view of the height-adjustable lighting fixture of FIG. 1 shown attached to a crossbeam.
Figure 3:
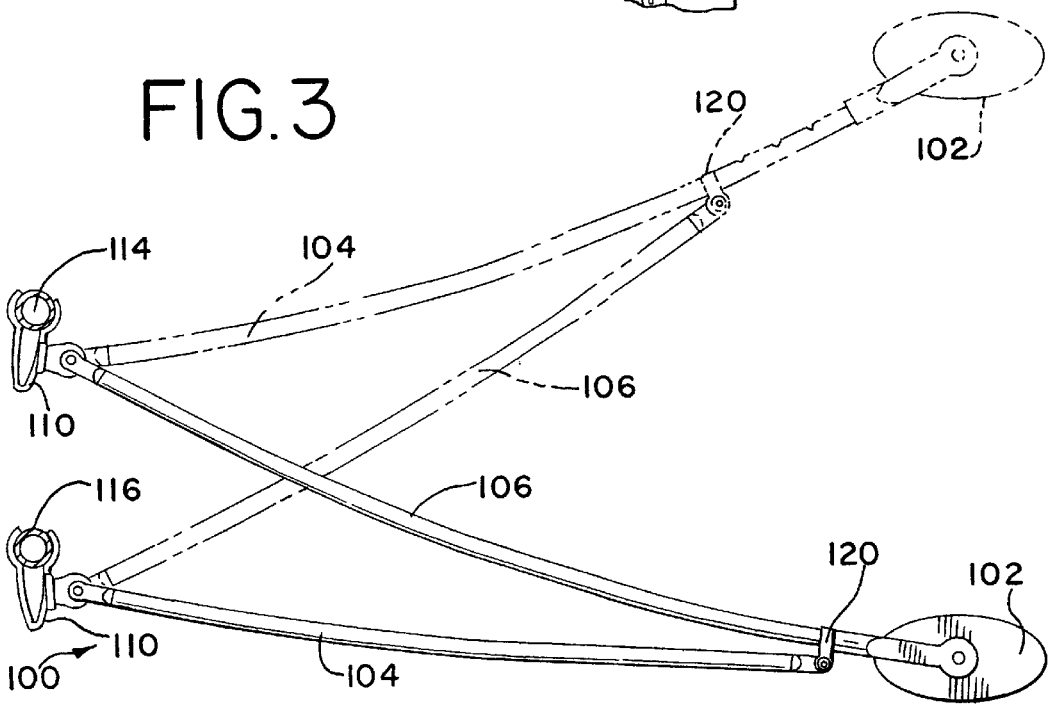
FIG. 3 is a side view of the height-adjustable lighting fixture of FIGS. 1–2 with two positions illustrated (one in phantom line).
Figure 4:
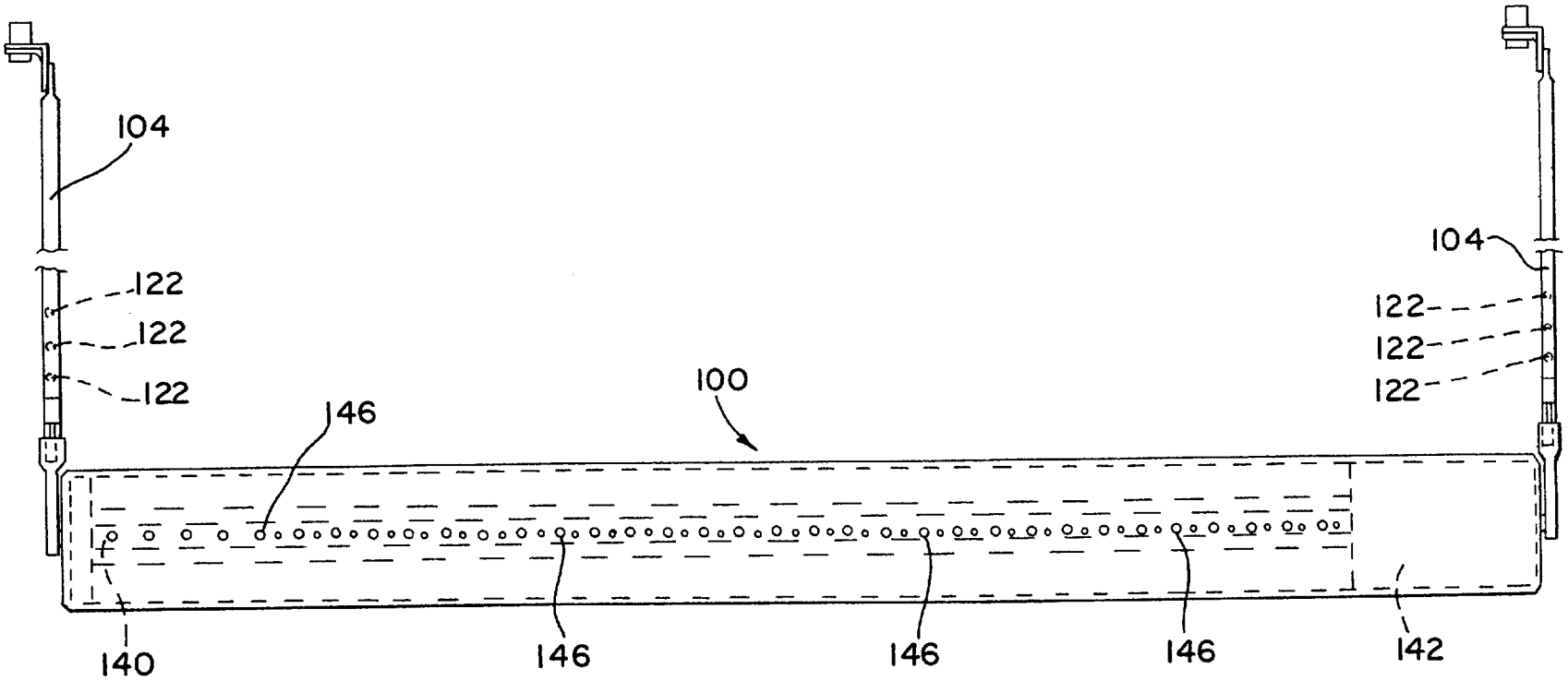
FIG. 4 is a bottom view of the height-adjustable lighting fixture of FIGS. 1–3.

The height-adjustable lighting fixture 100 is best shown in FIGS. 2–4. The height-adjustable lighting fixture 100 includes a housing 102 (preferably an aluminum extrusion) and an upper arm 104 (preferably steel tubing) and a lower arm 106 (preferably steel tubing) that cantilever off the crossbeam 22. The end portions of the upper arm 104 and the lower arm 106 include clamps 110 which engage the crossbeam 22 (particularly upper tube 114 and lower tube 116, respectively). The upper arm 104 and the lower arm 106 are pivotably connected to the clamps 110. The lower arm 106 includes a collar 120 that slidably engages the upper arm 104. The upper arm 104 includes a plurality of spaced apart apertures 122 extending along an upper portion thereof. The collar 120 includes a corresponding sized aperture such that a fastening device, such a screw, may fixedly engage the lower arm 106 in a selected position relative to the upper arm 104. Accordingly, the height-adjustable lighting fixture 100 includes a scissor action that allows it to be adjusted in height by selectably positioning the lower arm 106 with respect to the upper arm 104. FIG. 3 illustrates two possible positions. In a preferred embodiment, the height-adjustable lighting fixture 100 adjusts from 80–100 inches off a base surface.

The housing 102 includes a light source such as a T5 HO (high output) fluorescent lamp 140 connected to the ballast 142. A reflector preferably formed from specular aluminum extends beneath and partially around the fluorescent lamp 140. The reflector directs light projected downward from the fluorescent lamp 140 broadly upward which helps prevent a glare band on the ceiling. However, the reflector includes holes corresponding with the holes 146 in the bottom of the housing 102. The holes 146 allow a somewhat small amount of light to directly illuminate the work area of a user. The largest portion of the light created by the lamp 140 is projected broadly toward the ceiling generally without hotspots. As result, this light is reflected softly back down to the work area or workstation of a user.

Figure 5:
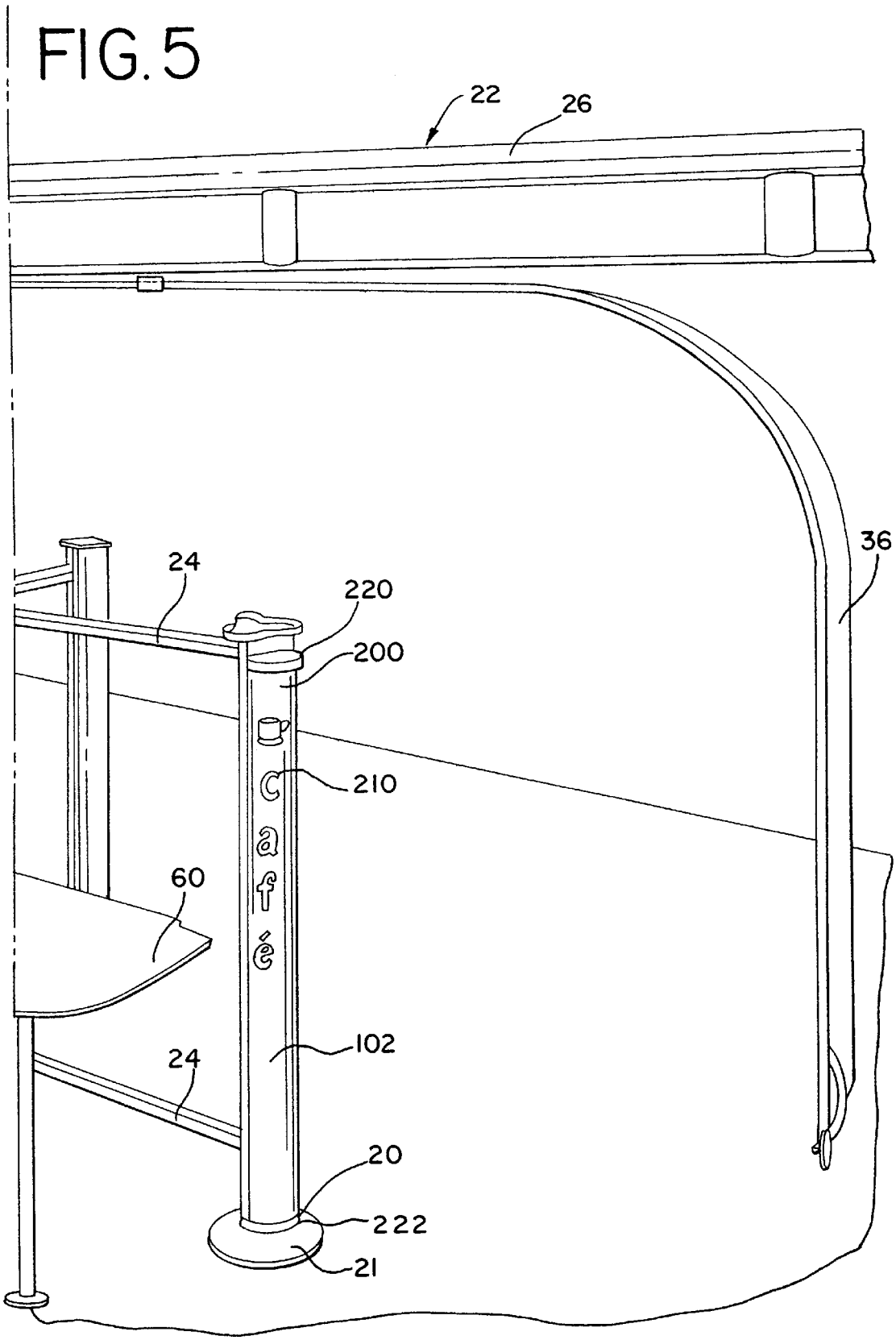
FIG. 5 is an enlarged view of another embodiment of the present invention illustrating the illuminated display member connected to a portion of a workspace management system.
Figure 6:
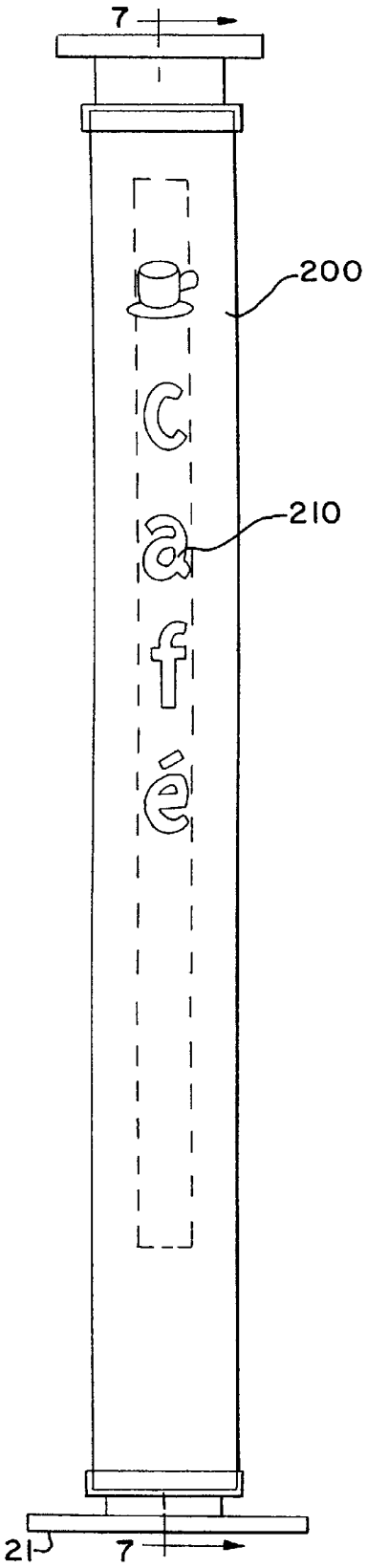
FIG. 6 illustrates a short pole having the illuminated display member connected thereto.

The preferred embodiment of the illuminated display member 102 is best shown in FIGS. 5–8. The illuminated or back-lit display member 102 is useful to readily convey information to a visitor to a particular work area, e.g., way-finding. As best shown in FIGS. 5 & 6, the display member 102 includes a cover 200. The cover 200 is preferably formed from a high impact extruded ABS plastic that is clear in color. The cover 200 includes a rear-retaining clip 202 that can accommodate a mylar sheet 206 having a printed graphic such as the café graphic 210 illustrated in the present embodiment. It should be recognized that the printed graphic can include a wide variety of information such as the presence of a team, group or individual in a particular location. In addition, the printed graphic can indicate a particular type of activity that takes place in a particular area. The printed graphic can include printed text or and/or image such as the café graphic 210. The display member 102 includes a top cap 220 and bottom cap 222 which snap onto the cover 200.

Figure 7:
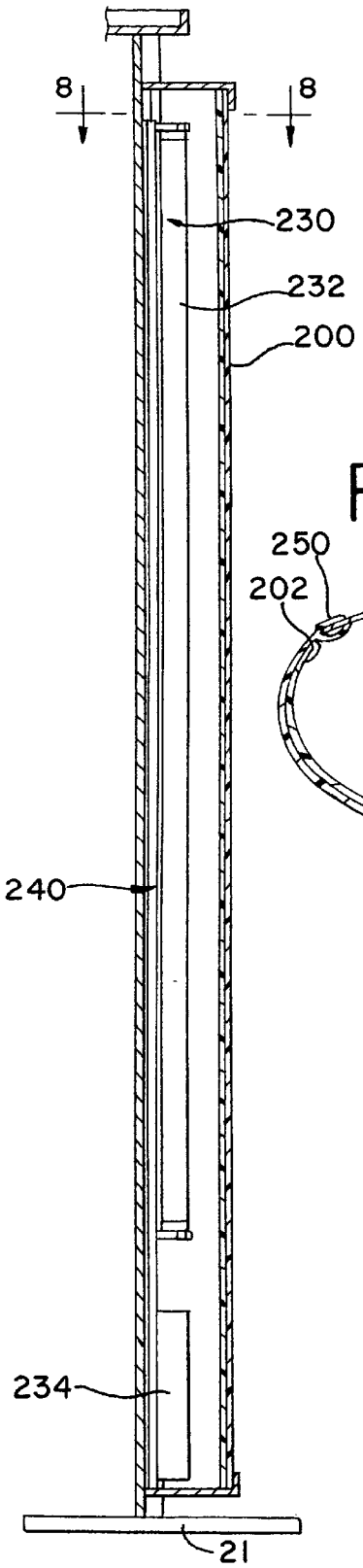
FIG. 7 illustrates a cross-section of the illuminated display member taken along the lines 7—7 of FIG. 6.
Figure 8:
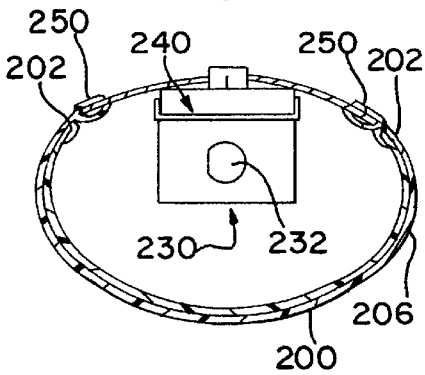
FIG. 8 illustrates a cross-section of the illuminated display member taken along the lines 8—8 of FIG. 7.

The display member 102 includes an illumination member or light source 230. The light source 230, best shown in FIGS. 7 & 8, is preferably T8 fluorescent tube 232 structure. The fluorescent tube 232 is connected to a normal power factor ballast 234. The fluorescent tube 232 is connected to a fixture 240 which in the preferred embodiment is 1" high by 1" wide by 48" long. Yet, it should be recognized that the display member and associated structure may be sized to suit the needs of a particular location. The fixture is mounted to the pole 20 using clips 250. A power cord (SJT type) exits the bottom of the fixture 240. A rocker switch may be attached to the cord to turn the power on/off.

The embodiments described above and shown herein are illustrative and not restrictive. The scope of the invention is indicated by the claims rather than by the foregoing description and attached drawings. The invention may be embodied in other specific forms without departing from the spirit of the invention. Accordingly, these and any other changes which come within the scope of the claims are intended to be embraced herein.

We claim:

1. A system for defining a plurality of work zones within an otherwise open area comprising:

a framework formed from a plurality of spaced apart poles extending upward from a base surface, the poles interconnected by a plurality of crossbeams at a height substantially above a standing user, at least some of the poles adapted to provide a raceway for the delivery of utilities; and a height-adjustable light fixture connected to the crossbeams, the light fixture extending outward from the crossbeams and capable of projecting a light beam directly downward on the work zone of a user.

2. The system of claim 1 wherein the crossbeams include an upper tube and a lower tube, the light fixture including clips for connection to both the upper tube and the lower tube.

3. The system of claim 2 wherein the light fixture includes an upper arm and a lower arm, the upper arm being connected to the upper tube and the lower arm being connected to the lower tube.

4. The system of claim 3 wherein the lower arm is slidably connected to the upper arm.

5. The system of claim 4 wherein the lower arm is selectably locked into position along the upper arm.

6. The system of claim 5 wherein the light fixture includes a housing and an illumination element.

7. The system of claim 6 wherein the housing is rotatable.

8. A system for defining a plurality of work zones within an otherwise open area comprising:

a framework formed from a plurality of spaced apart poles extending upward from a base surface, the poles interconnected by a plurality of crossbeams, the framework capable of being configured in groups of from one to six poles with a plurality of the groups having one or more work surfaces attached thereto in order to form a work area for a user; and an illuminated display member connected to at least one of the poles.

9. The system of claim 8 wherein the display includes text.

10. The system of claim 9 wherein the display is illuminated by a light source that extends along the length of the pole.

11. The system of claim 10 wherein the poles have at least two heights: 1) a tall pole that extends from a base surface over the head of a user and 2) a short pole that extends from a base surface to a height beneath the head of a user, the display member being attached to the short pole.

12. The system of claim 11 wherein the display includes a cover.

13. The system of claim 12 wherein the cover is adapted to receive an insert having printed text.

14. The system of claim 13 wherein the insert is formed from mylar.

15. The system of claim 14 wherein the light source includes a fluorescent tube.

16. The system of claim 15 wherein the text identifies the type of activities that take place in the work area.

* * * * *